US010069263B2

(12) United States Patent
Liao

(10) Patent No.: US 10,069,263 B2
(45) Date of Patent: Sep. 4, 2018

(54) ROTATABLE UNIVERSAL SOCKET

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 0 days.

(21) Appl. No.: 15/802,295

(22) Filed: Nov. 2, 2017

(65) Prior Publication Data

US 2018/0062334 A1 Mar. 1, 2018

Related U.S. Application Data

(62) Division of application No. 15/282,158, filed on Sep. 30, 2016, now Pat. No. 9,859,670.

(30) Foreign Application Priority Data

Jul. 1, 2016 (TW) ..... 105209967 U

(51) Int. Cl.
*H01R 27/00* (2006.01)
*H01R 31/06* (2006.01)

(52) U.S. Cl.
CPC ..... *H01R 27/00* (2013.01); *H01R 31/06* (2013.01)

(58) Field of Classification Search
CPC ..... H01R 35/04; H01R 27/00; H01R 31/06
See application file for complete search history.

(56) References Cited

U.S. PATENT DOCUMENTS 6,328,581 B1 * 12/2001 Lee ..... H01R 31/06
439/106

* cited by examiner

*Primary Examiner* — Briggitte R Hammond
(74) *Attorney, Agent, or Firm* — Li & Cai Intellectual Property (USA) Office

(57) ABSTRACT

A rotatable universal socket is provided, including a socket body on which a penetration hole is disposed, a socket unit disposed on the socket body and internally disposed with a plurality of conductive sheets. A plurality of plug holes is disposed on the socket unit, each plug hole is a universal plug hole, each of plug holes corresponds to each of conductive sheets, and the plurality of conductive sheets is electrically connected to a pin plug which extends from a rear side of the socket unit. The rotary disc is rotationally disposed between the socket body and the socket unit, a plurality of socket holes is disposed on the rotary disc, each socket hole has a specification different from the others, and the plurality of socket holes selectively correspond to the penetration hole and the plurality of plug holes, so that plugs with various different specifications can be plugged.

4 Claims, 20 Drawing Sheets

ROTATABLE UNIVERSAL SOCKET

CROSS-REFERENCE TO RELATED APPLICATIONS

This Application is a Divisional Application of U.S. patent application Ser. No. 15/282,158, filed on 30 Sep. 2016, and entitled ROTATABLE UNIVERSAL SOCKET.

BACKGROUND

1. Technical Field

The present disclosure relates to a rotatable universal socket, in particular, to a rotatable universal socket which is adapted to plugs having various specifications, used to supply power.

2. Description of Related Art

The current specifications of sockets and plugs vary from country to country and from place to place. For example, there are duplex receptacles and triplex receptacles provided in different nations. The receptacle in some countries may be the dual round hole electrical outlet, but it may have different specifications in the other countries. In addition, current, voltage, and so on can also vary as geographic location is varied. To travelers and businessmen, it is a troublesome and annoying problem that electronic devices such as a battery charger, a laptop, a razor, and so on cannot match the local specification of the electrical outlet.

Hence, the industry has been developing various adaptors to fit into the specifications of sockets and plugs in different countries for the user. However, most adaptors are designed as an adaptor with a single specification, meaning that the user has to bring various adaptors which may possibly correspond with the local specification.

SUMMARY

The primary purpose of the present disclosure is to provide a rotatable universal socket adapted to plugs having different specifications. In addition, it is user-friendly and can be switched easily to fit into socket holes with various specifications, thereby enabling the plug to plug into the socket stably.

In order to resolve the aforementioned technical problems, the present disclosure provides a rotatable universal socket, including: a socket body comprising a panel on which a penetration hole is disposed; a socket unit disposed on the socket body, a plurality of conductive sheets disposed in the socket unit, a plurality of plug holes disposed on the socket unit, wherein the plurality of plug holes are universal plug holes, the plurality of plug holes correspond to the plurality of conductive sheets, the plurality of conductive sheets electrically connect a pin plug which is disposed at and extends from a rear side of the socket unit, a rotary disc rotationally disposed between the socket body and the socket unit, and a plurality of socket holes disposed on the rotary disc, wherein each of the plurality of socket holes has a specification different from the others, and the plurality of socket holes selectively correspond to the penetration hole and the plurality of plug holes.

In order to resolve the aforementioned technical problems, the present disclosure provides another rotatable universal socket, including: a socket body comprising a panel on which a penetration hole is disposed; a socket unit disposed on the socket body, a plurality of conductive sheets disposed in the socket unit, a plurality of plug holes disposed on the socket unit, wherein the plurality of plug holes are universal plug holes, and the plurality of plug holes correspond to the plurality of conductive sheets; and a rotary disc rotationally disposed between the socket body and the socket unit, a plurality of socket holes disposed on the rotary disc, wherein each of the plurality of socket holes has a specification different from the others, and the plurality of socket holes selectively correspond to the penetration hole and the plurality of plug holes.

In order to resolve the aforementioned technical problems, the present disclosure provides yet another rotatable universal socket, including: a socket unit in which a plurality of conductive sheets are disposed, a plurality of plug holes disposed on the socket unit, wherein the plurality of plug holes are universal plug holes and correspond to the plurality of conductive sheets, and a rotary disc rotationally disposed on the socket unit, a plurality of socket holes disposed on the rotary disc, wherein each of the plurality of socket holes has a specification different from the others, and the plurality of socket holes selectively correspond to the plurality of the plug holes.

In order to resolve the aforementioned technical problems, the present disclosure provides yet another rotatable universal socket, including: a socket unit comprising at least two conductive sheets, and a rotary disc rotationally disposed on the socket unit, at least two sets of socket holes disposed on the rotary disc, wherein the at least two sets of socket holes have different specifications and selectively correspond to the at least two conductive sheets.

To sum up, the rotary disc of the present disclosure is provided with a plurality of socket holes, each of the plurality of socket holes has a specification different from the others, the socket body is disposed with the universal penetration hole and the socket unit is disposed with the universal plug holes, so that it is adapted to plugs having different specifications, thereby promoting the usage thereof. In addition, by using the rotary disc, the pin plug is positioned to correspond to the socket hole, thereby enabling the plug to plug into the socket unit more stably so as to have a better electrical connection.

The socket unit of the present disclosure is disposed with a pin plug which is electrically connected to the conductive sheets for supplying power to the conductive sheets. Thus the present disclosure can feasibly be used as an adaptor socket.

In addition, the present disclosure is provided with a notch disposed on the panel of the socket body, and the front side of the rotary disc is disposed with an adjusting part, thereby enabling the user to use their finger to rotate the adjusting part to rotate the rotary disc. The present disclosure further provides a knob which is pivotally disposed on the panel of the socket body, and one end of the knob is disposed with driving gear which is engaged with the adjusting part disposed at the outer periphery of the rotary disc, so that the user can rotate the knob disposed at the front side of the panel of the socket body to drive the driving gear to control the rotary disc to rotate, thereby promoting the usage thereof. There is no need to leave a space used to expose the rotary disc at the edge of the socket body, so the rotatable universal socket of the present disclosure can be disposed more flexibly and used more easily.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
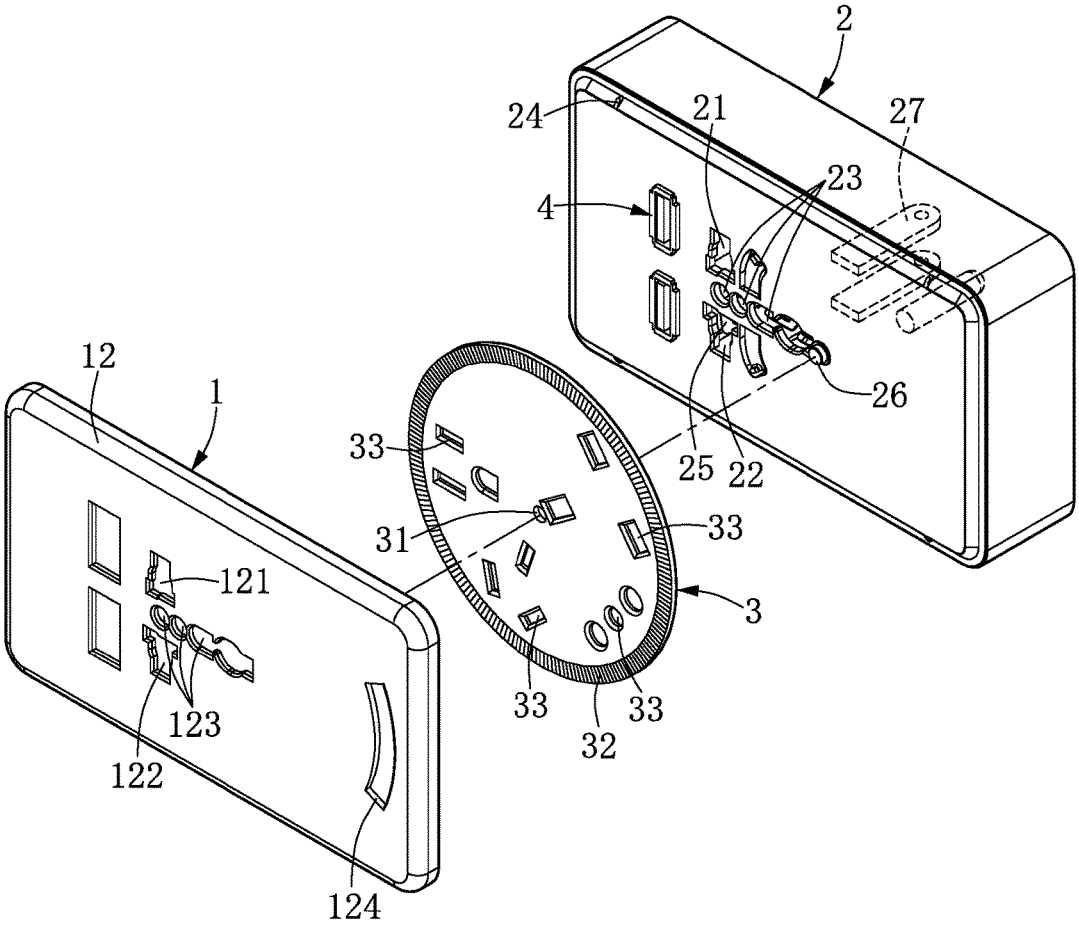
FIG. 1 is a three-dimensional exploded view of the first embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

First Embodiment

Figure 2:
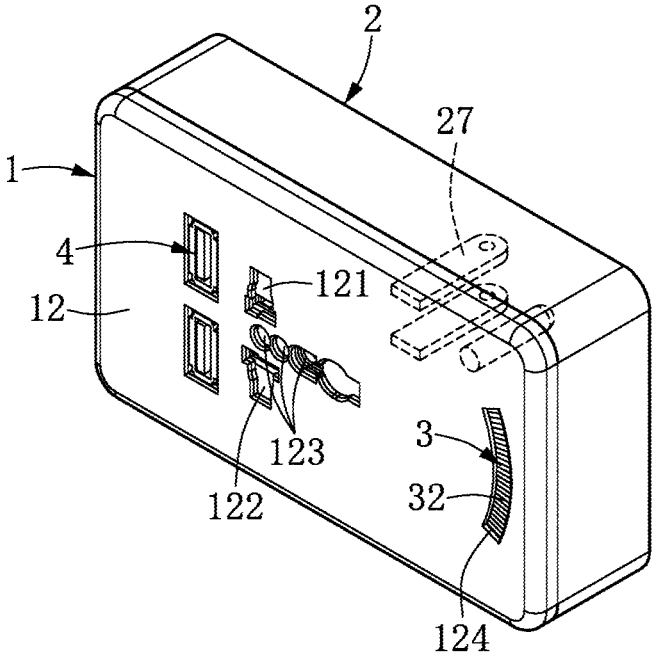
FIG. 2 is a three-dimensional assembly drawing of the first embodiment of the present disclosure.

Please refer to FIG. 1 and FIG. 2. A rotatable universal socket which is adapted to an adaptor socket, a wall socket, a power strip, and so on is provided, but the present disclosure is not limited thereto. In the present embodiment, an adaptor socket is provided, which includes a socket body 1, a socket unit 2 and a rotary disc 3.

The socket body 1 is made of insulating materials such as plastic, and may be a one-piece or multi-piece structure, but the present disclosure is not limited thereto. In the present embodiment, the socket body 1 includes a panel 12 of which the shape may be a rectangle or another. A plurality of penetration holes 121, 122, 123 are disposed on the panel 12, wherein the plurality of penetration holes 121, 122, 123 are universal penetration holes and provided for various pin plugs to pass there-through.

The socket body 1 is disposed with at least one connector 4, and the connector 4 is disposed to extend in the socket unit 2, wherein the connector 4 may be electrical connectors such as a universal serial bus (USB) connector, an IEEE1394 connector, a high-definition multimedia interface (HDMI) connector, an audio video (AV) connector, a direct current (DC) connector, and so on. The connector 4 is exposed at a front side of the socket body 1, thereby enabling an external connector to connect to the connector 4.

In the present embodiment, the socket unit 2 is disposed on the socket body 1, and the socket unit 2 is fixed on the panel 12 of the socket body 1 by using tenons 24 respectively disposed on upper and a lower edges of the socket unit 2, so that the socket unit 2 can be disposed at a rear side of the socket body 1 and a front side (front side) of the socket unit 2 can face the panel 12.

The socket unit 2 is a universal socket module (referred to as a multi-purpose socket). That is, the socket unit 2 is internally provided with a plurality of conductive sheets 25 which are used to electrically connect to various pin plugs. The plurality of conductive sheets 25 are electrically connected to a pin plug 27, wherein the pin plug 27 is disposed at and extends from a rear side of the socket unit 2 and is used to plug into a socket for providing the plurality of conductive sheets 25 with power.

One side (front side) of the socket unit 2 facing the panel 12 is disposed with a plurality of plug holes 21, 22, 23, and the plurality of plug holes 21, 22, 23 are disposed corresponding to the plurality of penetration holes 121, 122, 123, wherein the plug hole 23 is disposed in the center of the socket unit 2 and usually a ground plug hole, and the plug holes 21, 22 are respectively disposed at two sides of the plug hole 23 and usually the power plug holes. The present disclosure is not limited thereto. The plurality of plug holes 21, 22, 23 are adapted to pin plugs having different shapes such as inclined, straight, flat, and circular, and so on. The plurality of plug holes 21, 22, 23 are universal plug holes and disposed corresponding to the plurality of conductive sheets 25 disposed in the socket unit 2 for enabling the pin plug to plug thereinto, so that the pin plug is in contact with the corresponding conductive sheets 25 to have an electrical connection thereto. One side (front side) of the socket unit 2 facing the panel 12 is disposed with a pivot 26 on which a rotary disc 3 is pivotally disposed.

The rotary disc 3 can be a circular or polygonal disc body, and is rotationally disposed at one side (front side) of the socket unit 2. In this embodiment, the rotary disc 3 is provided with a pivot hole 31, the pivot hole 31 and the pivot 26 are mutually pivoted so that the rotary disc 3 is rotationally pivoted on the socket unit 2, and the present disclosure is not limited to the pivoting means. For example, the rotary disc 3 can also be provided with a pivot, the socket unit 2 provided with a pivot hole, or the rotary disc 3 pivotally disposed on the socket unit 2 in other ways, thereby enabling the rotary disc 3 to rotate relative to the socket unit 2.

The rotary disc 3 is located between the socket body 1 and the socket unit 2. In the present embodiment, an arc-shaped notch 124 is formed on the panel 12. The rotary disc 3 is disposed with an adjusting part 32, and the adjusting part 32 is located at one side (front side) of the rotary disc 3, wherein the adjusting part 32 has concave-convex textures and is a circular shape. The notch 124 and the adjusting part 32 are concentrically disposed. The adjusting part 32 corresponds to the notch 124 of the panel 12, thereby enabling the adjusting part 32 to be exposed on the panel 12 through the notch 124. A width of the notch 124 is bigger than a width of the adjusting part 32, and the present disclosure is not limited thereto. The user can use their finger to slide the adjusting part 32 to rotate the rotary disc 3. In the present embodiment, the user can rotate the rotary disc 3 through the notch 124 disposed at a front side of the panel 12 of the socket body 1, making it easier to operate the present disclosure.

A plurality of socket holes 33 is disposed on the rotary disc 3 at intervals, and each of the plurality of socket holes 33 has a specification different from the others. For example, the plurality of socket holes 33 can be single hole, two holes, three holes or a number of holes of which the shape may be long, flat, circular, and so on. The specifications of the plurality of socket holes 33 are not limited thereto, and it can be a Taiwan, Italian, US, Australian, European, and other specifications.

The users can rotate the rotary disc 3 to enable one of the plurality of socket holes 33 to correspond to one of the plurality of plug holes 21, 22, 23 disposed on the socket unit 2, so that a pin plug of an electric appliance which matches one of the plurality of socket holes 33 and one of the plurality of plug holes 21, 22, 23 can plug into the chosen socket hole and the penetration hole through the corresponding plug hole to electrically connect to the conductive sheets 25 of the socket unit 2. Thus the pin plug of an electric appliance and the conductive sheets 25 of the socket unit 2 have an electrical connection, thereby enabling power to be supplied to the electric appliance.

When using a pin plug of an electric appliance having another specification, the user can rotate the rotary disc 3 again to enable one of the plurality of socket holes 33 to correspond to one of the plurality of plug holes 21, 22, 23 disposed on the socket unit 2, so that the pin plug of an electric applicant which matches one of the plurality of socket holes 33 and one of the plurality of plug holes 21, 22, 23 can plug into the chosen socket hole and the penetration hole through the corresponding plug hole to electrically connect to the conductive sheets 25 of the socket unit 2. Thus the pin plug of the electric appliance and the conductive sheets 25 of the socket unit 2 have an electrical connection, thereby enabling power to be supplied to the electric appliance.

Second Embodiment

Figure 3:
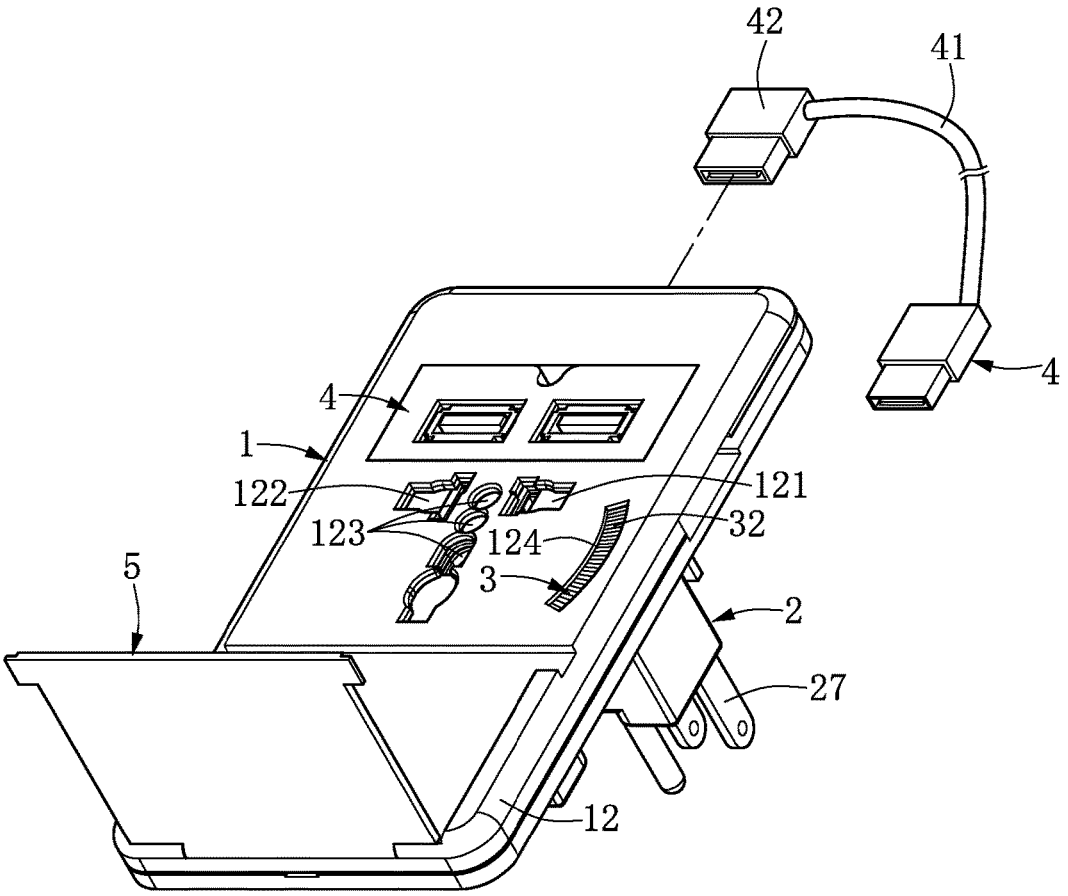
FIG. 3 is a three-dimensional assembly drawing of the second embodiment of the present disclosure.

Please refer to FIG. 3. The present embodiment further provides a carrying board 5 which is disposed at a front side of the panel 12 of the socket body 1. The carrying board 5 is pivotally disposed on the panel 12, and is turnable on the panel 12. The carrying board 5 can be turned upward to attach to the front side of the panel 12. A connector 4 is disposed on the socket body 1, and is connected to one end of a connection wire 41. The other end of the connection wire 41 is connected to a plug 42, and the plug 42 is plugged into an internal side of the panel 12 of the socket body 1 for being electrically connected to various electric appliances. The connection wire 41 and the connector 4 are selectively accommodated at an edge of the socket body 1.

Third Embodiment

Figure 4:
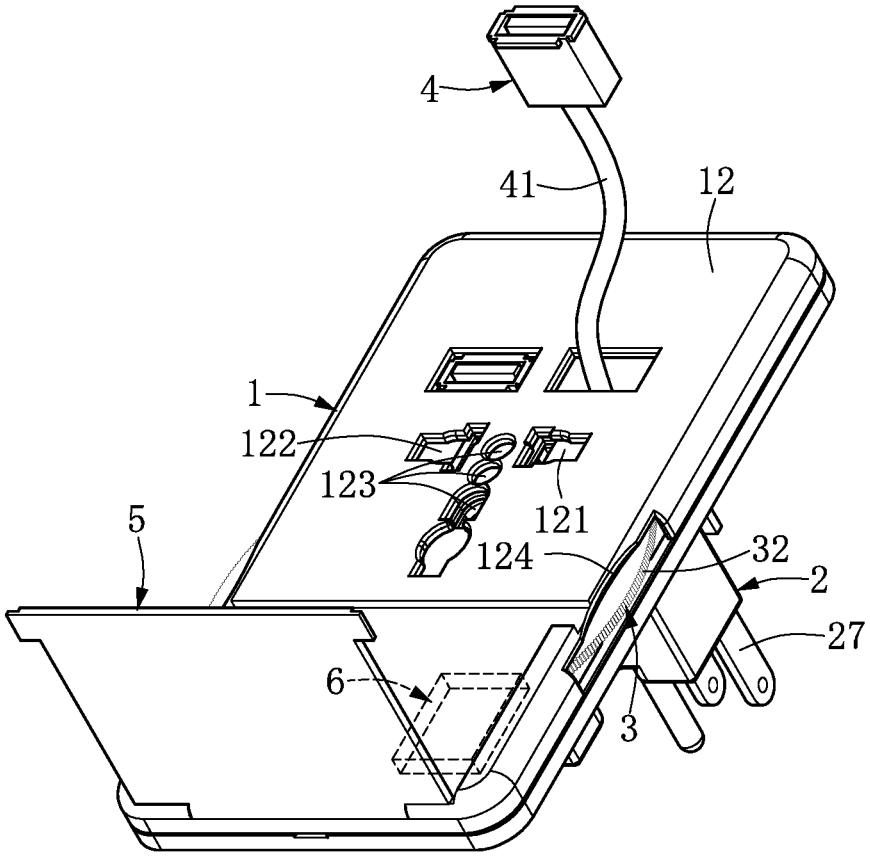
FIG. 4 is a three-dimensional assembly drawing of the third embodiment of the present disclosure.

Please refer to FIG. 4. In the present embodiment, it further provides a wireless charging transmitter 6 disposed on the socket body 1 or on the carrying board 5. The wireless charging transmitter 6 is electrically connected to the circuit unit of the plug or various electric appliances by using wires (not shown). As the socket is disposed with the wireless charging transmitter 6, when there is an electrical product disposed with the wireless charging receiver (not shown) provided on the carrying board 5, the wireless charging transmitter 6 can supply power to the wireless charging receiver of the electrical product through the transmission protocol of the wireless communication, so that the electronic product placed on the carrying board 5 can be charged wirelessly. The connector 4 is disposed on the socket body 1, and is connected to one end of the connection wire 41. The other end of the connection wire 41 extends to an internal side of the panel 12 of the socket body 1, and the connector 4 is provided to electrically connect to various electric appliances. The connector 4 and the connection wire 41 can be pulled outside the socket body 1 when they are used.

In the present embodiment, the adjusting part 32 is disposed on an outer periphery of the rotary disc 3, and the notch 124 is disposed at an edge of the panel 12. The adjusting part 32 is exposed on the panel 12 through the notch 124, so that the user can rotate the rotary disc 3 through the adjusting part 32.

Fourth Embodiment

Figure 5:
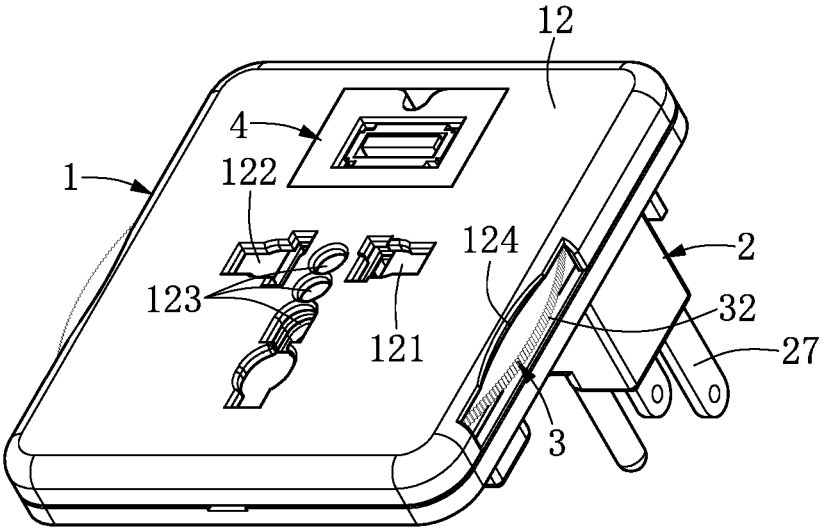
FIG. 5 is a three-dimensional assembly drawing of the fourth embodiment of the present disclosure.

Please refer to FIG. 5. In the present embodiment, the structure, shape and specification of the socket can be made according to the actual requirements. In addition, the connector 4 can be formed as a connector module to be detachably disposed on the socket body 1.

Fifth Embodiment

Figure 6:
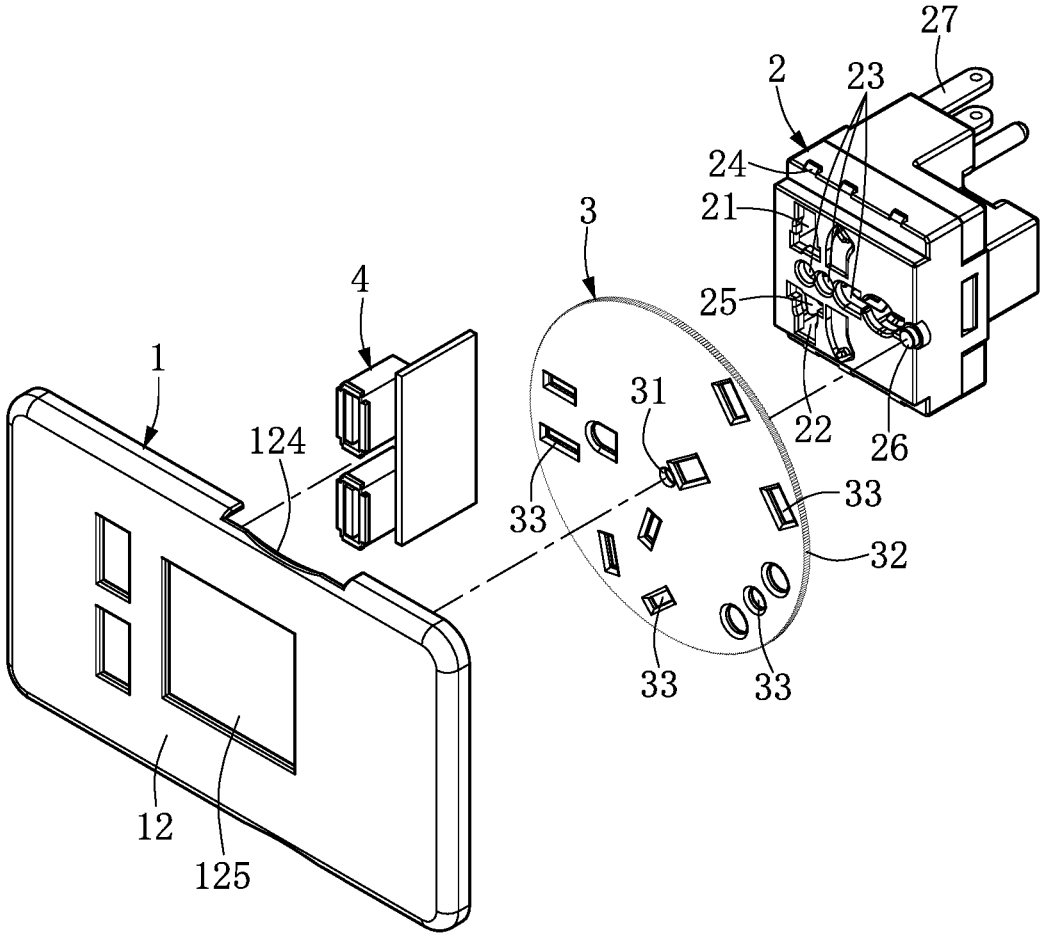
FIG. 6 is a three-dimensional exploded view of the fifth embodiment of the present disclosure.

Please refer to FIG. 6. In the present embodiment, a penetration hole 125 disposed on a large area of the panel 12 used to replace the plurality of penetration holes 121, 122, 123 mentioned above, wherein the penetration hole 125 may be a rectangular shape or another shape. An area of the penetration hole 125 is larger than a total area of the plurality of plug holes 21, 22, 23. The plurality of socket holes 33 disposed on the rotary disc 3 selectively correspond to the penetration hole 125 and the plurality of plug holes 21, 22, 23.

Sixth Embodiment

Figure 7:
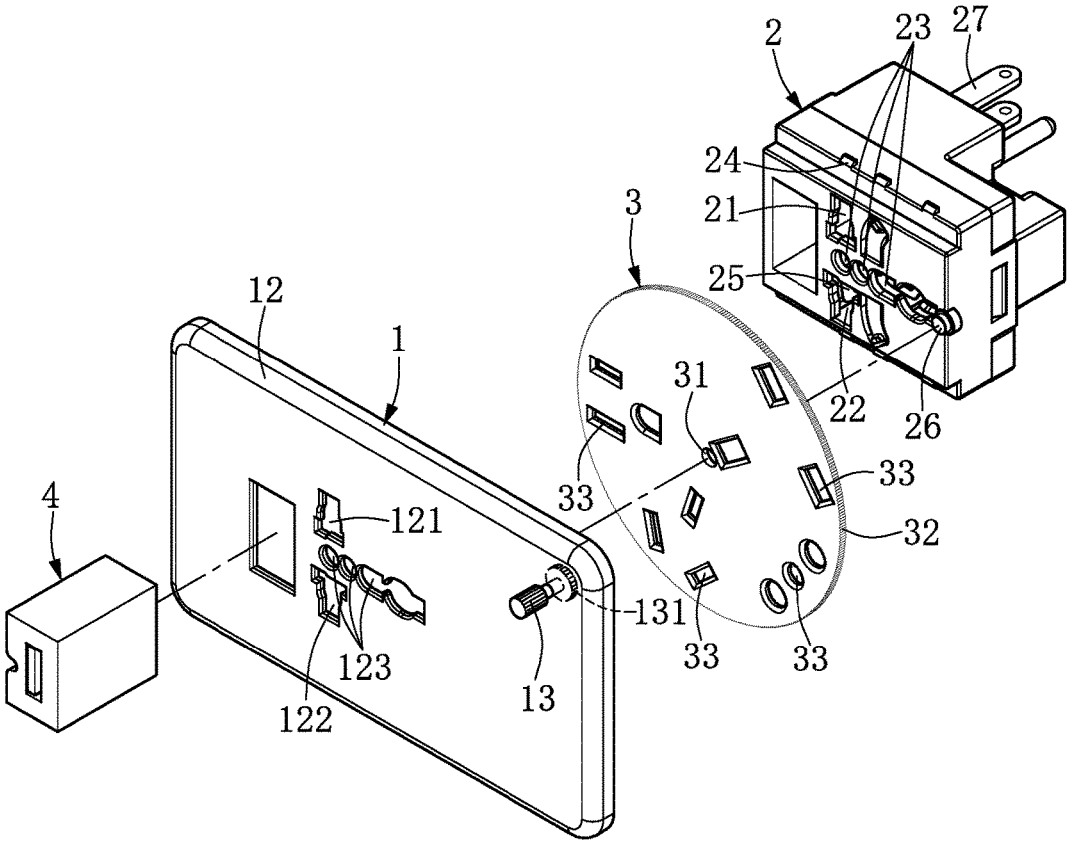
FIG. 7 is a three-dimensional exploded view of the sixth embodiment of the present disclosure.

Please refer to FIG. 7. In the present embodiment, the connector 4 is formed as a connector module and detachably disposed on the socket body 1 and the socket unit 2. In addition, a knob 13 is pivotally disposed on the panel 2 of the socket body 1 of the present embodiment. The knob 13 is rotationally disposed on the panel 12 and protrudes from one side (front side) of the panel 12. One end of the knob 13 extends to an internal part of the panel 12, and the other end of the knob 13 is disposed with a driving gear 131 which is engaged with the adjusting part 32. When the user rotates the knob 13, the driving gear 131 is driven by the knob 13 to drive the adjusting part 32 and the rotary disc 3 to rotate, which is beneficial to the user of the present disclosure.

Seventh Embodiment

Figure 8:
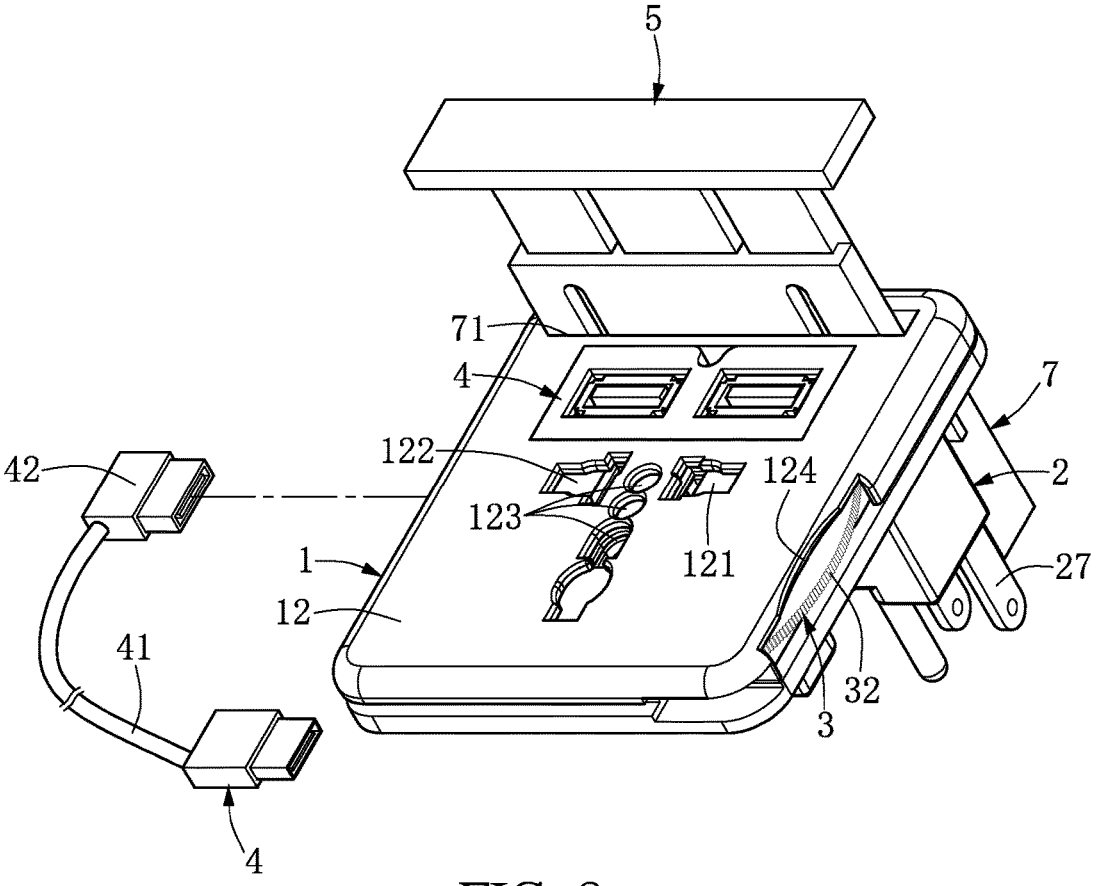
FIG. 8 is a three-dimensional assembly drawing of the seventh embodiment of the present disclosure.

Please refer to FIG. 8. In the present embodiment, it further provides a storage box 7, a front side of the storage box 7 is disposed with an opening 71. The storage box 7 is disposed at a rear side of the socket body 1. The carrying board 5 is disposed in the storage box 7 and can slide back and forth along the opening 71. The carrying board 5 can be pulled outside the storage box 7 along the opening 71, so that an electrical product can be placed on the carrying board 5.

Eighth and Ninth Embodiments

Figure 9:
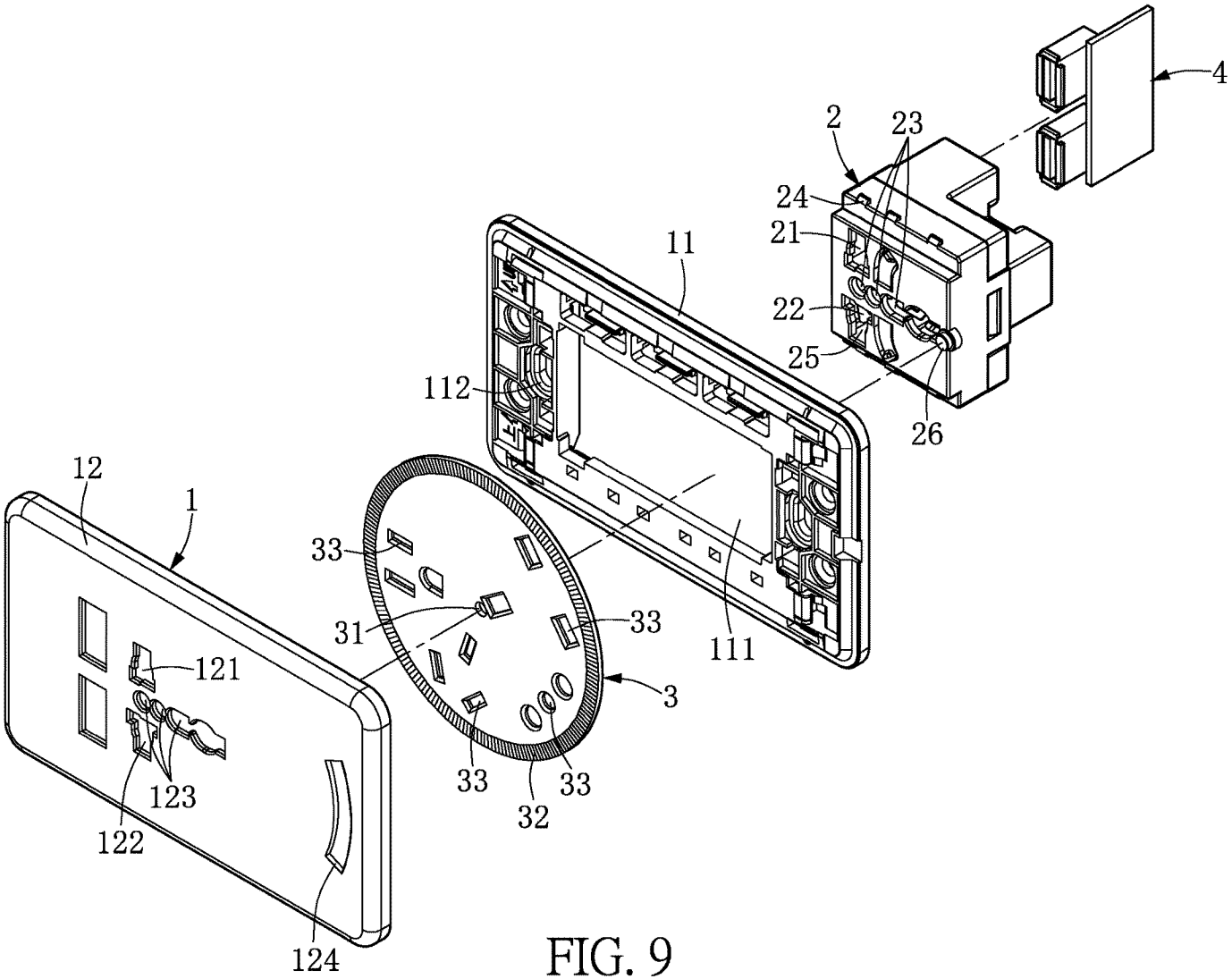
FIG. 9 is a three-dimensional exploded view of the eighth embodiment of the present disclosure.
Figure 10:
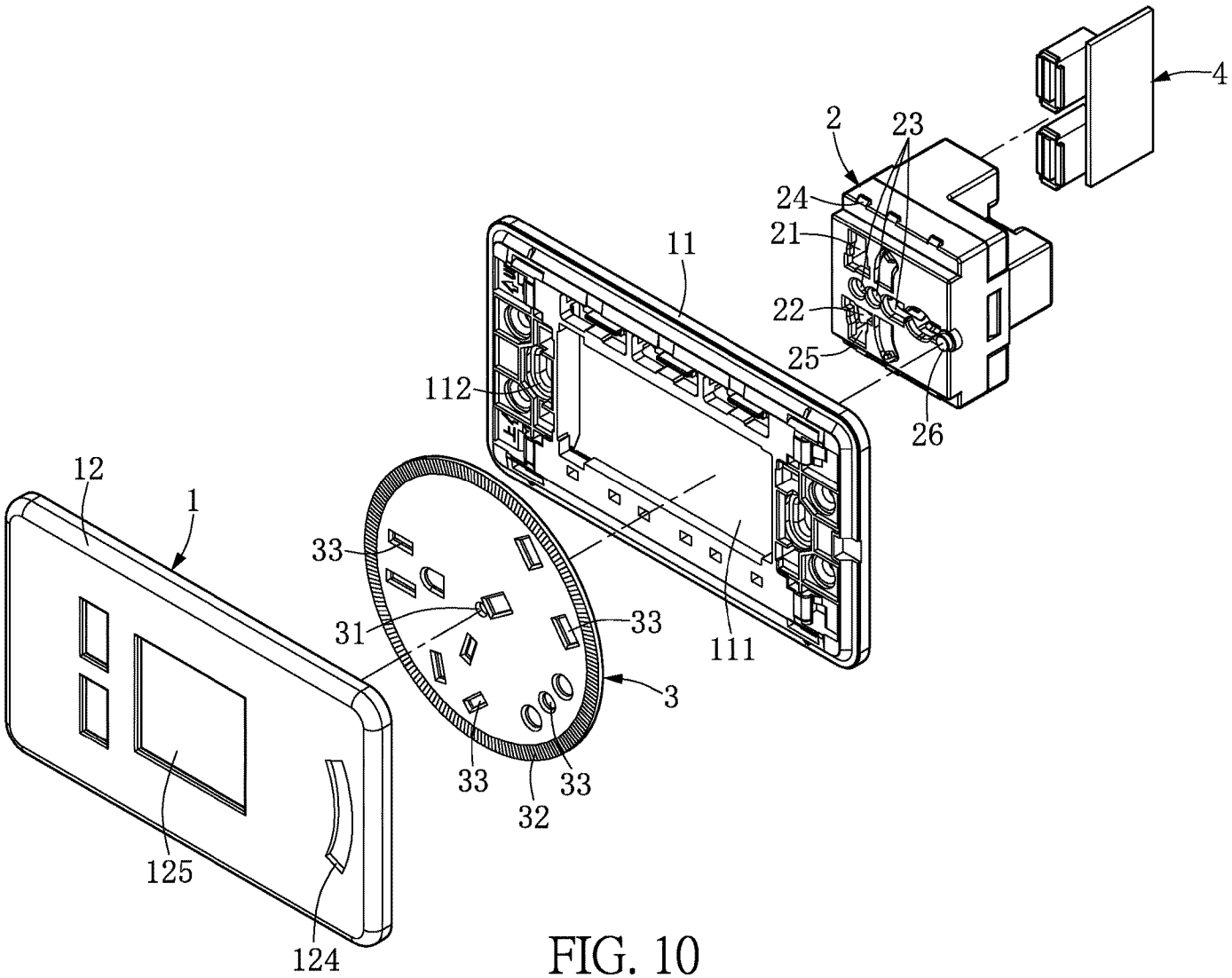
FIG. 10 is a three-dimensional exploded view of the ninth embodiment of the present disclosure.

Please refer to FIG. 9 and FIG. 10. In these embodiments, the rotatable universal socket is a wall socket. The socket body 1 includes a base 11 and the panel 12. The panel 12 is disposed at a front side of the base 11, and is fixed on the base 11 by using a clamp or screw. An accommodating portion 111 is provided in the middle of the base 11 for accommodating the socket unit 2. A pair of fixing holes 112 is respectively disposed at two sides of the base 11, and the base 12 can be fixed on the wall by using a screw. In the embodiments, a plurality of tenons 24 respectively disposed at the upper and lower edges of the socket unit 2 are used to fix the socket unit 2 on the base 11 of the socket body 1, thereby enabling the socket unit 2 to be disposed in the accommodating portion 111 of the base 11 and the other side (front side) of the socket unit 2 to face the panel 12. In the embodiments, the details of the pin plug 27 are not repeated. The conductive sheets 25 are electrically connected to a power line (not shown) by means of welding or other manner, so that power can be supplied to the conductive sheets 25 through the power line.

The rotary disc 3 is disposed between the base 11 and the panel 12, that is, the rotary disc 3 is between the socket body 1 and the socket unit 2. In the embodiments, the adjusting part 32 is disposed at one side (front side) of the rotary disc 3, the notch 124 is disposed on the panel 124, and the adjusting part 32 is exposed on the panel 12 through the notch 124, so that the user can rotate the rotary disc 3 by using the adjusting part 32.

Tenth Embodiment

Figure 11:
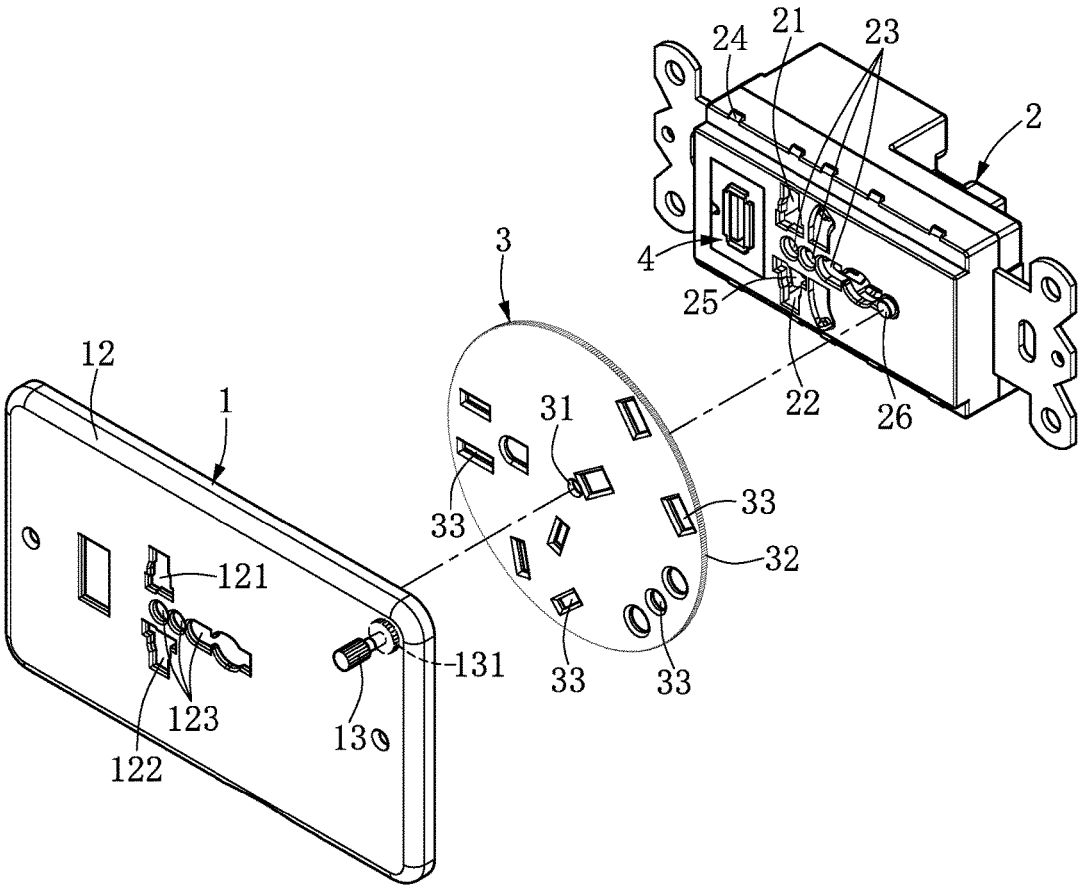
FIG. 11 is a three-dimensional exploded view of the tenth embodiment of the present disclosure.

Please refer to FIG. 11. In the present embodiment, the socket unit 2 is formed in compliance with the US specification. The socket body 1 includes the panel 12, but does not include the base 11 mentioned above. The rotary disc 3 is disposed between the panel 12 of the socket body 1 and the socket unit 2.

Eleventh, Twelfth and Thirteenth Embodiments

Figure 12:
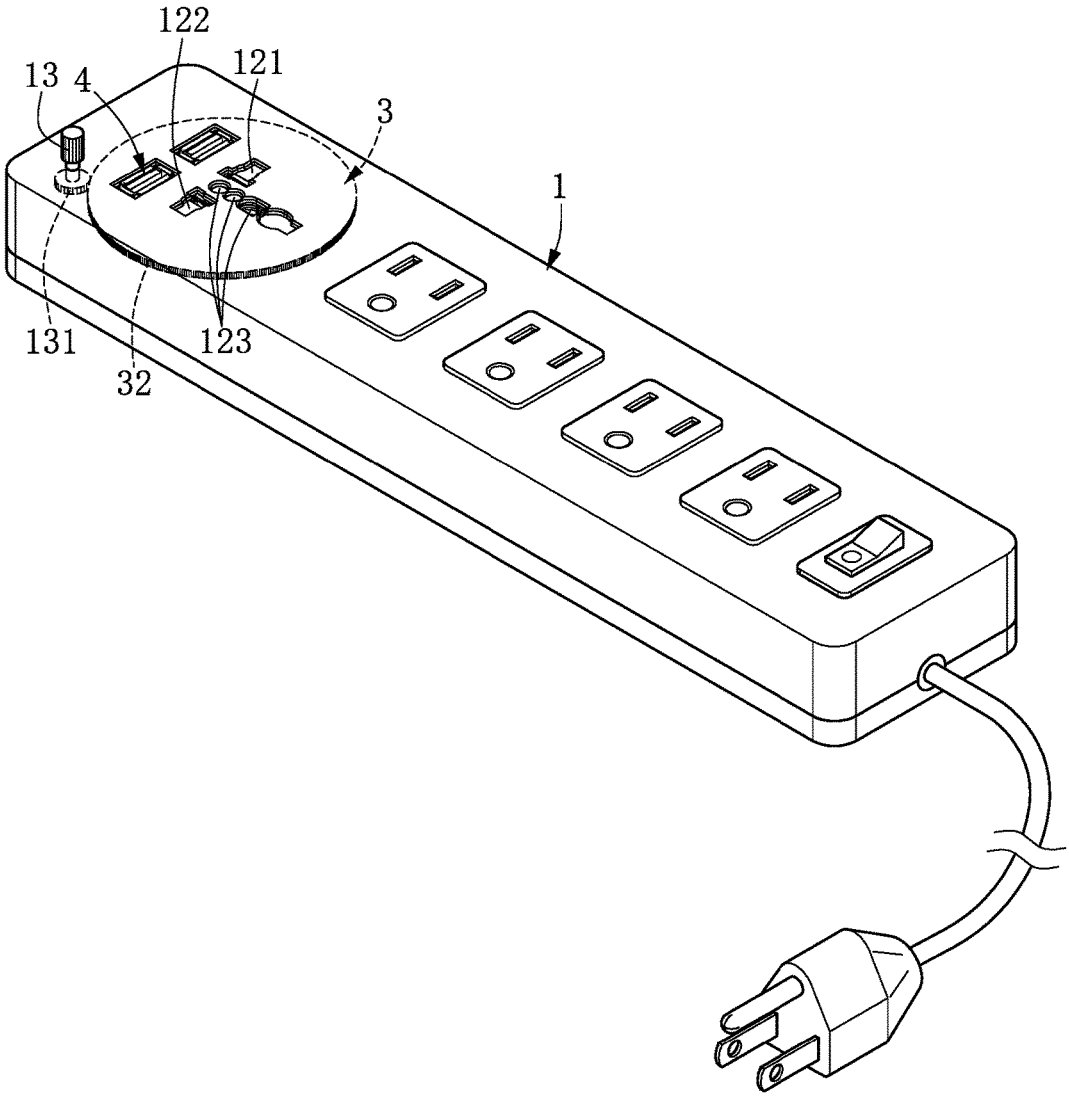
FIG. 12 is a three-dimensional assembly drawing of the eleventh embodiment of the present disclosure.
Figure 13:
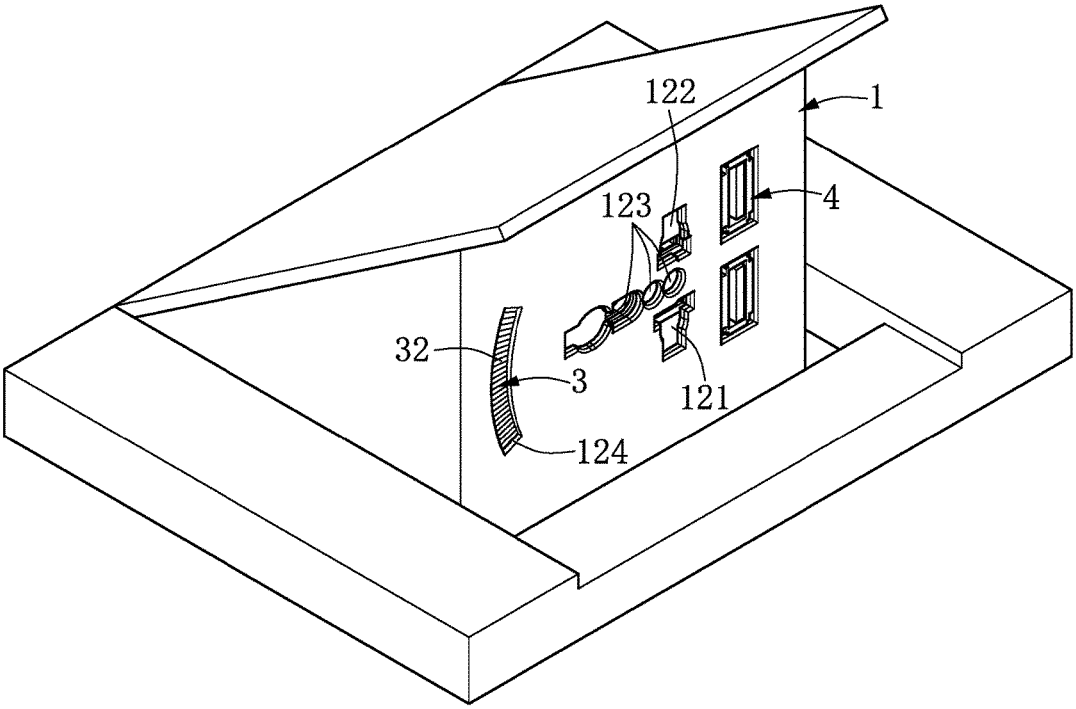
FIG. 13 is a three-dimensional assembly drawing of the twelfth embodiment of the present disclosure.
Figure 14:
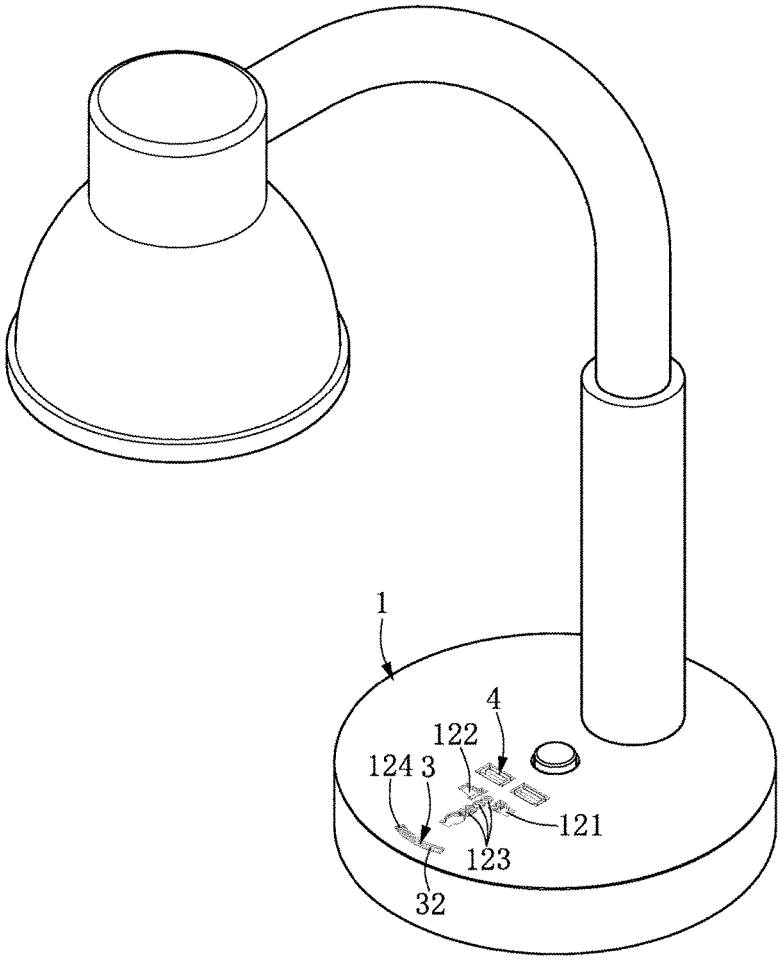
FIG. 14 is a three-dimensional assembly drawing of the thirteen embodiment of the present disclosure.

Please refer to FIG. 12, where a power strip is provided. Please refer to FIG. 13, where a socket disposed on a desk or ground is provided. Please refer to FIG. 14, where a socket disposed on a lamp is provided.

Fourteenth Embodiment

Figure 15:
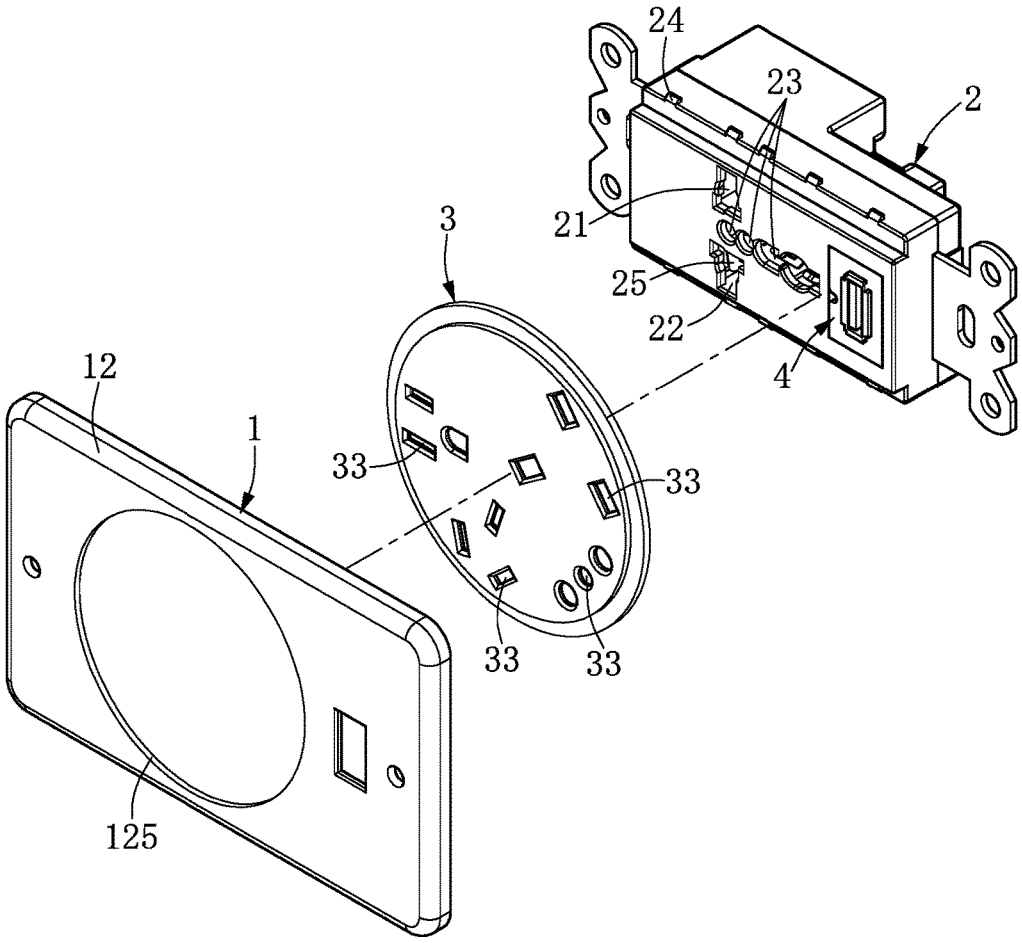
FIG. 15 is a three-dimensional exploded view of the fourteenth embodiment of the present disclosure.

Please refer to FIG. 15. In the present embodiment, a penetration hole 125 disposed on a large area of the panel 12 of the socket body 1 is provided, wherein the penetration hole 125 has a circular shape and is used to replace the penetration holes 121, 122, 123 mentioned above. An area of the penetration hole 125 is larger than a total area of the plurality of plug holes 21, 22, 23. The rotary disc 3 is pivotally disposed on the penetration hole 125. The plurality of socket holes 33 disposed on the rotary disc 3 selectively correspond to the plurality of plug holes 21, 22, 23.

Fifteenth Embodiment

Figure 16:
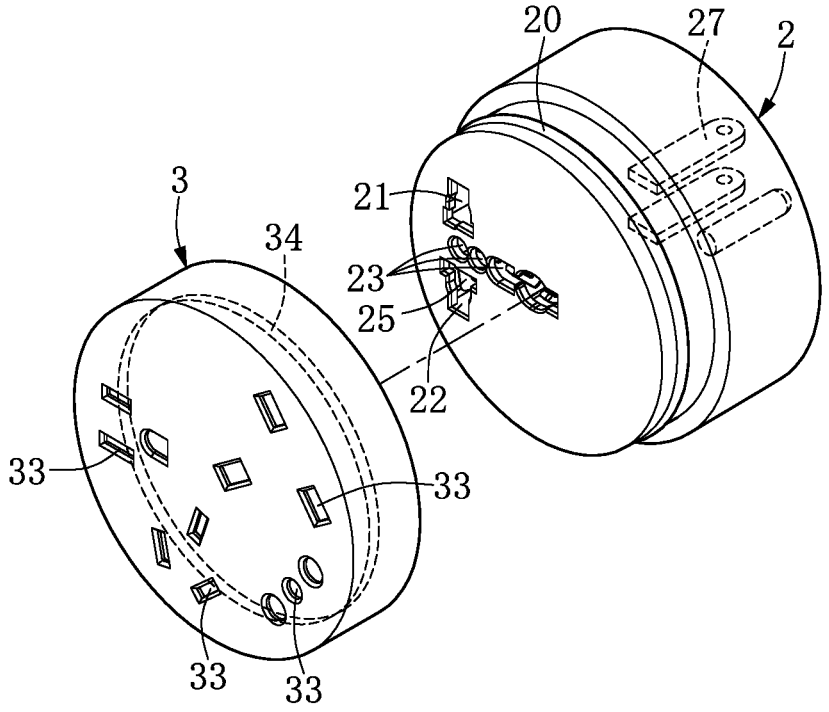
FIG. 16 is a three-dimensional exploded view of the fifteenth embodiment of the present disclosure.

Please refer to FIG. 16. In the present embodiment, the details of the socket body 1 are not repeated. The plurality of conductive sheets 25 are disposed in the socket unit 2, and the plurality of plug holes 21, 22, 23 are disposed on the socket unit 2, wherein the plurality of plug holes 21, 22, 23 are universal plug holes. The plurality of plug holes 21, 22, 23 correspond to the plurality of conductive sheets 25. The rotary disc 3 is rotationally disposed on the socket unit 2, and the plurality of socket holes 33 are disposed on the rotary disc 3, wherein each of the plurality of socket holes 33 has a specification different from the others, and the plurality of socket holes 33 selectively correspond to the plurality of plug holes 21, 22, 23. In the present embodiment, the rotary disc 3 is a circular hollow body, and is sheathed to a cylinder formed at a front side of the socket unit 2, thereby enabling the rotary disc 3 to rotate flexibly. An internal edge of the rotary disc 3 is disposed with a first positioning part 34 (such as a convex positioning ring), and an external edge of the socket unit 2 is disposed with a second positioning part 20 (such as a concave positioning groove). The first positioning part 34 and the second positioning part 20 are connected with each other to enable the rotary disc 3 to be positioned on the socket unit 2.

Sixteenth and Seventeenth Embodiments

Figure 17:
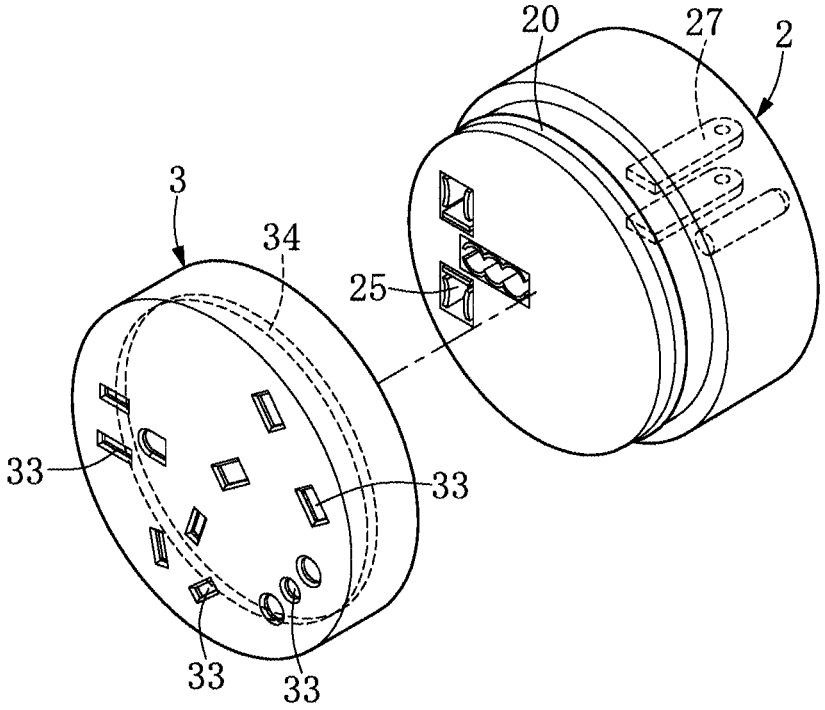
FIG. 17 is a three-dimensional exploded view of the sixteenth embodiment of the present disclosure.
Figure 18:
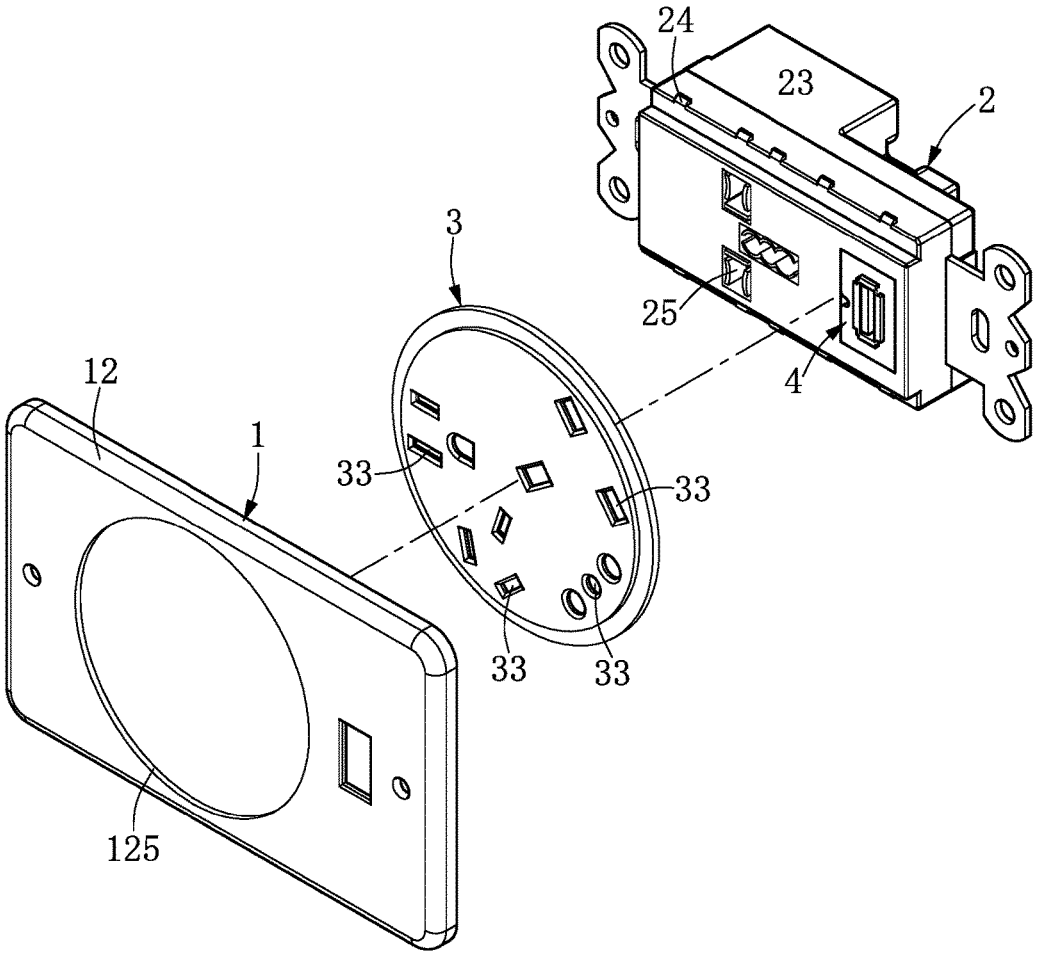
FIG. 18 is a three-dimensional exploded view of the seventeenth embodiment of the present disclosure.

Please refer to FIG. 17 and FIG. 18. In the embodiments, the socket unit 2 is disposed with at least two conductive sheets 25. The rotary disc 3 is rotationally disposed on the socket unit 2 and has at least two sets of socket holes 33, wherein the at least two sets of socket holes 33 have different specifications. The at least two sets of socket holes 33 selectively correspond to the at least two conductive sheets 25.

Eighteenth Embodiment

Figure 19:
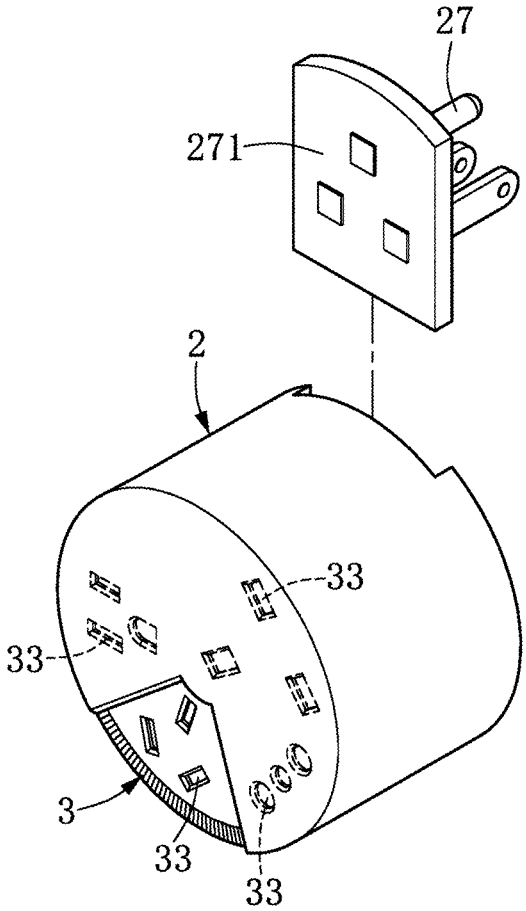
FIG. 19 is a three-dimensional diagram of the eighteenth embodiment of the present disclosure.

Please refer to FIG. 19. In the present embodiment, the details of the socket body 1 mentioned above are not repeated. The socket unit 2 is disposed with at least two conductive sheets (not shown), the rotary disc 3 is rotationally disposed on the socket unit 2. At least two sets of socket holes 33 are disposed on the rotary disc 3 and have different specifications. The at least two sets of socket holes 33 selectively correspond to the at least two conductive sheets. In the present embodiment, the pin plug 27 is fixed on a base seat 271, the base seat 271 is detachably disposed at a rear side of the socket unit 2, and the pin plug 27 is electrically connected to the conductive sheets 25. The base seat 271 can be made according to the actual requirements, and the pin plug 27 can be formed in compliance with Australian, European, US specifications, and so on. The pin plug 27 is disposed at and extends from a rear side of the socket unit 2 and can be plugged into the socket for supplying power to the conductive sheets 25.

Nineteen Embodiment

Figure 20:
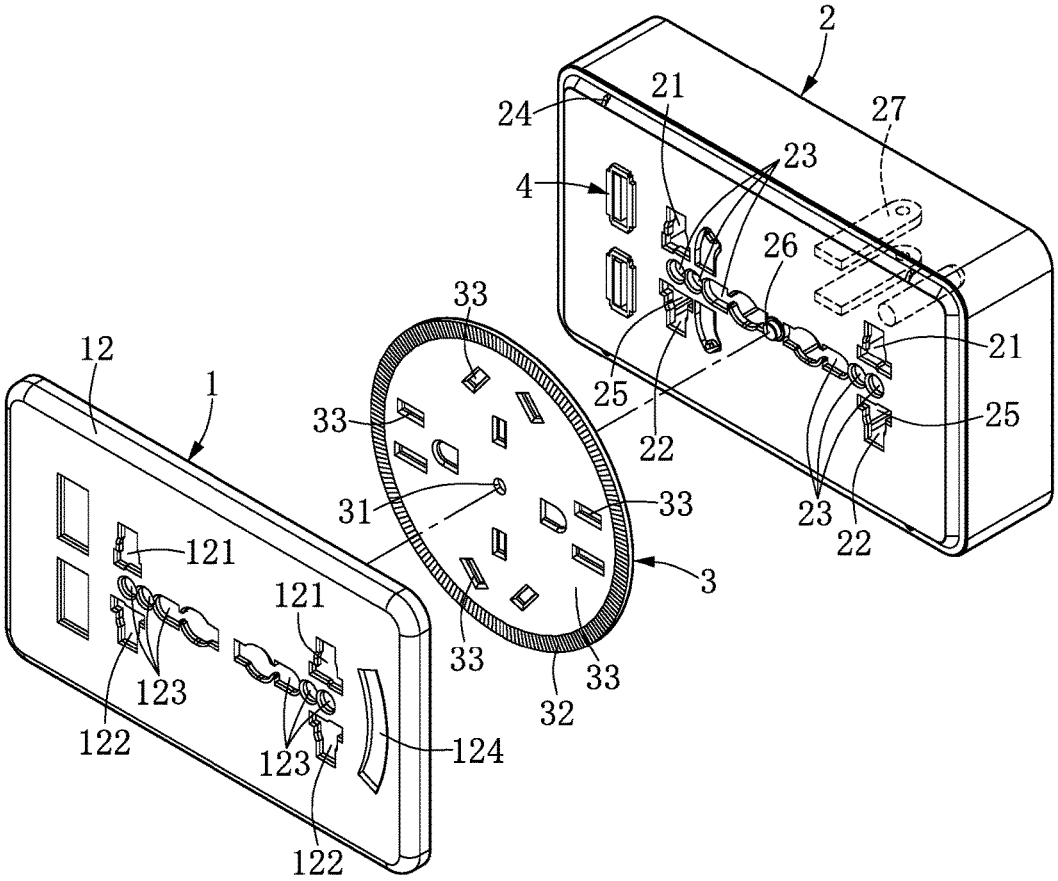
FIG. 20 is a three-dimensional diagram of the nineteen embodiment of the present disclosure.

Please refer to FIG. 20. In the present embodiment, two sets of the penetration holes 121, 122, 123 are disposed opposite to each other on the socket body 1, two sets of the plurality of plug holes 21, 22, 23 and the conductive sheets 25 are disposed opposite to each other on the socket unit 2, and the plurality of socket holes 33 are disposed opposite to each other on the rotary disc 3, thereby allowing two plugs to plug into the present disclosure at the same time.

The rotary disc of the present disclosure is provided with a plurality of socket holes, each of the plurality of socket holes has a specification different from the others, the socket body is disposed with the universal penetration hole, and the socket unit is disposed with the universal plug holes, so that the present disclosure is adapted to plugs having different specifications, thereby promoting the usage thereof. In addition, by using the rotary disc, the pin plug is positioned to correspond to the socket hole, thereby enabling the plug to plug into the socket unit more stably so as to have a better electrical connection.

The socket unit of the present disclosure is disposed with the pin plug which is electrically connected to the conductive sheets for supplying power to the conductive sheets. Thus the present disclosure can feasibly be used as an adaptor socket.

In addition, the present disclosure is provided with the notch disposed on the panel of the socket body, and the front side of the rotary disc is disposed with the adjusting part, thereby enabling the user to use their finger to rotate the adjusting part to rotate the rotary disc. The present disclosure further provides the knob which is pivotally disposed on the panel of the socket body, and one end of the knob is disposed with the driving gear which is engaged with the adjusting part disposed at the outer periphery of the rotary disc, so that the user can rotate the knob disposed at the front side of the panel of the socket body to drive the driving gear to control the rotary disc to rotate, thereby promoting the usage thereof. There is no need to leave a space which is used to expose the rotary disc at the edge of the socket body, which is beneficial as the rotatable universal socket of the present disclosure can be disposed more flexibly and used more easily.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A rotatable universal socket, comprising:

a socket unit comprising at least two conductive sheets arranged between a center axis and an outer edge of the socket unit, and a rotary disc rotationally disposed on the socket unit, at least two sets of socket holes disposed on the rotary disc, wherein the at least two sets of socket holes have different specifications and are arranged in a circle around the center axis of the socket unit such that only one set of the at least two sets of socket holes corresponds to the at least two conductive sheets during one rotation of the rotary disc.

2. The rotatable universal socket according to claim 1, wherein the rotary disc is a circular hollow body, and is sheathed to a cylinder formed at a front side of the socket unit.

3. The rotatable universal socket according to claim 2, wherein an internal edge of the rotary disc is disposed with a first positioning part and an external edge of the socket unit is disposed with a second positioning part.

4. The rotatable universal socket according to claim 3, wherein the first positioning part and the second positioning part are connected with each other to enable the rotary disc to be positioned on the socket unit.

* * * * *